US006602614B2

(12) United States Patent
Doujak et al.

(10) Patent No.: US 6,602,614 B2
(45) Date of Patent: Aug. 5, 2003

(54) COATED METAL WIRE, WIRE-REINFORCED ELASTOMERIC ARTICLE CONTAINING THE SAME AND METHOD OF MANUFACTURE

(75) Inventors: Siegfried Doujak, Merzig (DE); Federico Pavan, Florence (IT); Andrea Pieralli, Faella Piandisco (IT)

(73) Assignee: Pirelli Pneumatici S.p.A., Milan (IT)

( * ) Notice: Subject to any disclaimer, the term of this patent is extended or adjusted under 35 U.S.C. 154(b) by 0 days.

(21) Appl. No.: 10/201,912

(22) Filed: Jul. 25, 2002

(65) Prior Publication Data

US 2003/0003319 A1 Jan. 2, 2003

Related U.S. Application Data

(62) Division of application No. 09/427,709, filed on Oct. 27, 1999, now Pat. No. 6,475,640.
(60) Provisional application No. 60/106,626, filed on Nov. 2, 1998.

(30) Foreign Application Priority Data

Oct. 28, 1998 (EP) ..... 98120359

(51) Int. Cl.[7] ..... B32B 15/01

(52) U.S. Cl. ..... 428/646; 428/657; 428/658; 428/674

(58) Field of Search ..... 428/646, 657, 428/658, 674

(56) References Cited

U.S. PATENT DOCUMENTS

| | | | | |
|---|---|---|---|---|
| 2,002,261 | A | * | 5/1935 | Domm |
| 4,018,570 | A | * | 4/1977 | Nakamoto et al. |
| 4,645,718 | A | * | 2/1987 | Dambre |
| 4,859,289 | A | * | 8/1989 | Nishimura et al. |
| 4,911,991 | A | * | 3/1990 | Van Ooij |
| 4,952,249 | A | * | 8/1990 | Dambre |
| 5,338,620 | A | * | 8/1994 | Van Ooij et al. |
| 5,730,851 | A | * | 3/1998 | Arrowsmith et al. |

* cited by examiner

*Primary Examiner*—Archene Turner
(74) *Attorney, Agent, or Firm*—Finnegan, Henderson, Farabow, Garrett & Dunner, L.L.P.

(57) ABSTRACT

A brass coated metallic wire for use as a reinforcing component in an elastomeric article, such as a motor vehicle tire. The brass coating is formed by depositing alternate layers of copper and zinc on the wire and then drawing the wire under conditions of temperature and pressure suitable to alloy the copper and zinc to form a brass coating on the wire.

13 Claims, 2 Drawing Sheets

COATED METAL WIRE, WIRE-REINFORCED ELASTOMERIC ARTICLE CONTAINING THE SAME AND METHOD OF MANUFACTURE

This application is a division of application Ser. No. 09/427,709, filed Oct. 27, 1999, which has issued as U.S. Pat. No. 6,475,640 and is incorporated herein by reference, and claims the benefit of U.S. Provisional Application No. 60/106,626 filed on Nov. 2, 1998.

The invention relates to metal wire particularly adapted for drawing to form a brass surface coating thereon, a resulting brass-coated metal wire adapted for use in wire reinforced elastomeric articles, such as vehicle tires, hoses, conveyor belts, a wire-reinforced elastomeric article containing this wire, and a method for producing the brass coated metal wire.

In various applications, such as hoses, cables, and especially tires for motor vehicles, it is known to use metal wires as reinforcement components of the article. Particularly in tires, this reinforcement is achieved by embedding coated metallic wires in the elastomeric compound material of the tire, especially when the elastomeric compound material is used in the belts and carcass of the tire. The wires have a coating to improve the adhesion of the wire to the elastomeric compound material of the tire, and to inhibit corrosion of the metal wire. The metal wire can corrode if it enters in contact with the atmosphere, for example due to damage to the elastomeric compound material, and the corrosion can spread along the wire to other portions of the tire.

Specifically, in this regard, it is known to coat steel wires with brass of the composition, in weight percent, about 70 copper and 30 zinc. The most widely used practice is to sequentially deposit coatings of copper and zinc and then heat the wire so coated for a suitable time at a proper temperature to diffuse the copper and zinc sufficiently and form the desired brass coating. In another approach the coatings are formed by co-deposition using, for example, a cyanide bath.

This prior-art practice has the disadvantage of requiring an excessive number of manufacturing steps. For example, it is necessary after the plurality of deposition steps and the diffusion step to pickle the resulting brass coating in an acid solution to remove the zinc oxide formed at the relatively high temperatures and long times necessary to achieve the required diffusion, and to insure a slight phosphorization of the wire which facilitates the subsequent drawing of the coated wire to reduce the coated wire to the desired dimensions. The diffusion step, which is typically conducted at temperatures within the range of about 450 to 500° C., may cause a reduction in the tensile strength of the coated steel wire. The reduction can be of as much as 5% of the original tensile strength of the material. This tensile strength reduction impairs the effectiveness of the wire when used in the intended reinforcing application, particularly when used as a reinforcing component in motor vehicle tires.

It is known in the art that a strong bond between metal wires and rubber can be obtained if the metal wire is coated with a layer of brass, as described in U.S. Pat. No. 4,486,477. Various methods have been developed to form a coating on a metal wire. For example, U.S. Pat. No. 4,226,918 discloses a ferrous wire having a homogeneous coating of nickel and copper. The wire is drawn, then is thermally softened, and is pickled before entering an electrolytic bath of copper and zinc cyanide. After the homogeneous coating is deposited, the coated wire is drawn to the desired dimensions.

Similarly, U.S. Pat. No. 4,828,000 discloses a steel substrate with a brass covering layer to enhance adhesion to the rubber, wherein the covering layer has on its surface a ratio Cu/(Cu+Zn) of no more than 0.2. The reduction of copper percentage at the surface is obtained by heating the coated metal in an inert atmosphere to a temperature of between 250° C. and 350° C.

SUMMARY OF THE INVENTION

In accordance with the present invention, a coated metal wire is produced that provides significant advantages over prior art products of this type, particularly when employed as a reinforcing component in an elastomeric compound material of the type used in the construction of motor vehicle tires. The elastomeric compound material may be an elastomer of either natural or synthetic origin having rubber-like characteristics, comprising fillers such as carbon black and silica are added.

In the production of the brass-coated wire in accordance with the invention, was found that diffusion of deposited copper and zinc layers to form the desired alloy coating of brass results during the wire-drawing operation, after deposition of these copper and zinc coatings. Although electrodeposition is preferred for depositing these layers, other known practices including chemical vapor deposition may also be used.

It has been determined that in the vulcanization operation used in tire manufacture and during which the brass coating of the wire is adhered to the elastomeric compound material, maximum effectiveness of adhesion is obtained when the copper content of the brass coating is relatively high at the outer surface of the coating, contacting the elastomeric compound material. In fact, the outer portion of the coating that actually bonds with the elastomeric compound material, also referred to as the reaction surface, is only approximately 20 nanometers thick. The adhesive reaction between the brass and elastomeric compound material results during vulcanization by the formation of chemical bonding therebetween by disulfide bond formation. This reaction is improved and promoted by the copper of the brass alloy, because copper reacts more rapidly than zinc with the elastomeric compound material. Consequently, the bonding is facilitated by increasing the concentration of copper at the reaction surface of the brass coating. To obtain optimum adhesion, the concentration of copper at the reaction surface can be controlled according to the invention to match the characteristics of the elastomeric compound material being used, by selecting a composition and thickness of the most external deposited layer.

Further, with the relative amounts of copper and zinc in accordance with the ranges of the invention, the drawability of the coated wire is improved. Specifically, this results when the crystallographic structure of substantially all of the brass coating is the face centered cubic alpha phase with only minor amounts and preferably trace amounts of the body centered cubic beta phase. It has been determined that the face centered cubic alpha phase is significantly more deformable than the body centered cubic beta phase, and thus the predominance of this former phase facilitates the wire drawing operation.

In accordance with one aspect of the invention, a metal wire, which is particularly adapted for drawing to form a brass surface coating thereon, is provided with at least three alternate alloying layers, each being of copper or zinc. The most external of these layers is, however, of copper. Preferably, the most internal of the at least three layers is also of copper. The wire onto which these layers are deposited is preferably steel. The number of alternate alloying layers is preferably within the range of 3 to 5.

The alloying layers, in combination, may consist essentially of, in weight percent, about 60 to 72 copper and balance zinc, preferably about 70 copper and about 30 zinc.

The metal wire may have a diameter of about 0.8 to 3.0 mm with the alloying layers in combination having a thickness of about 0.75 to 4.0 microns. The thickness of the most external layer of copper is preferably about 0.1 to 0.5 microns. Preferably, the thickness of the most external copper layer could be selected to obtain a desired copper concentration on an outer surface of the coated metal wire.

The brass coating on the drawn wire preferably has a copper content of the outer surface greater than a copper content of any remaining portion of the brass coating. The brass coating preferably consists essentially of, in weight percent, about 60 to 72 copper and balance zinc, more preferably about 70 copper and about 30 zinc.

The drawn wire preferably has a diameter of about 0.12 to 0.8 mm, with the brass coating having a thickness of about 0.1 to 0.3 microns.

The brass coated wire, in accordance with the invention, may be contained as a reinforcing element within an elastomeric article, such as a motor vehicle tire. The brass coating is chemically bonded to the elastomeric article by disulfide bonds formed between the brass coating and the composition of the elastomeric article. The elastomer of the compound material may be of either natural or synthetic origin.

In accordance with the method of the invention, a brass coated metal wire is produced by depositing on a metal wire at least three alternate alloying layers each being one of copper or zinc. The most external and most internal of the layers are copper. This coated wire is then subjected to a drawing operation which produces high temperature and pressure to alloy the copper and zinc layers and form the desired brass layer. The metal of the wire is preferably steel and the number, composition and thickness of the deposited layers are as set forth above. These alloying layers may be deposited by electro-deposition.

BRIEF DESCRIPTION OF THE DRAWINGS

The accompanying drawings are included to provide further understanding of the invention and are incorporated in and constitute part of the specification, illustrate one embodiment of the invention, and together with the description serve to explain the principles of the invention. In the drawings.

DETAILED DESCRIPTION OF THE EXPERIMENTAL WORK AND EMBODIMENTS

Figure 1:
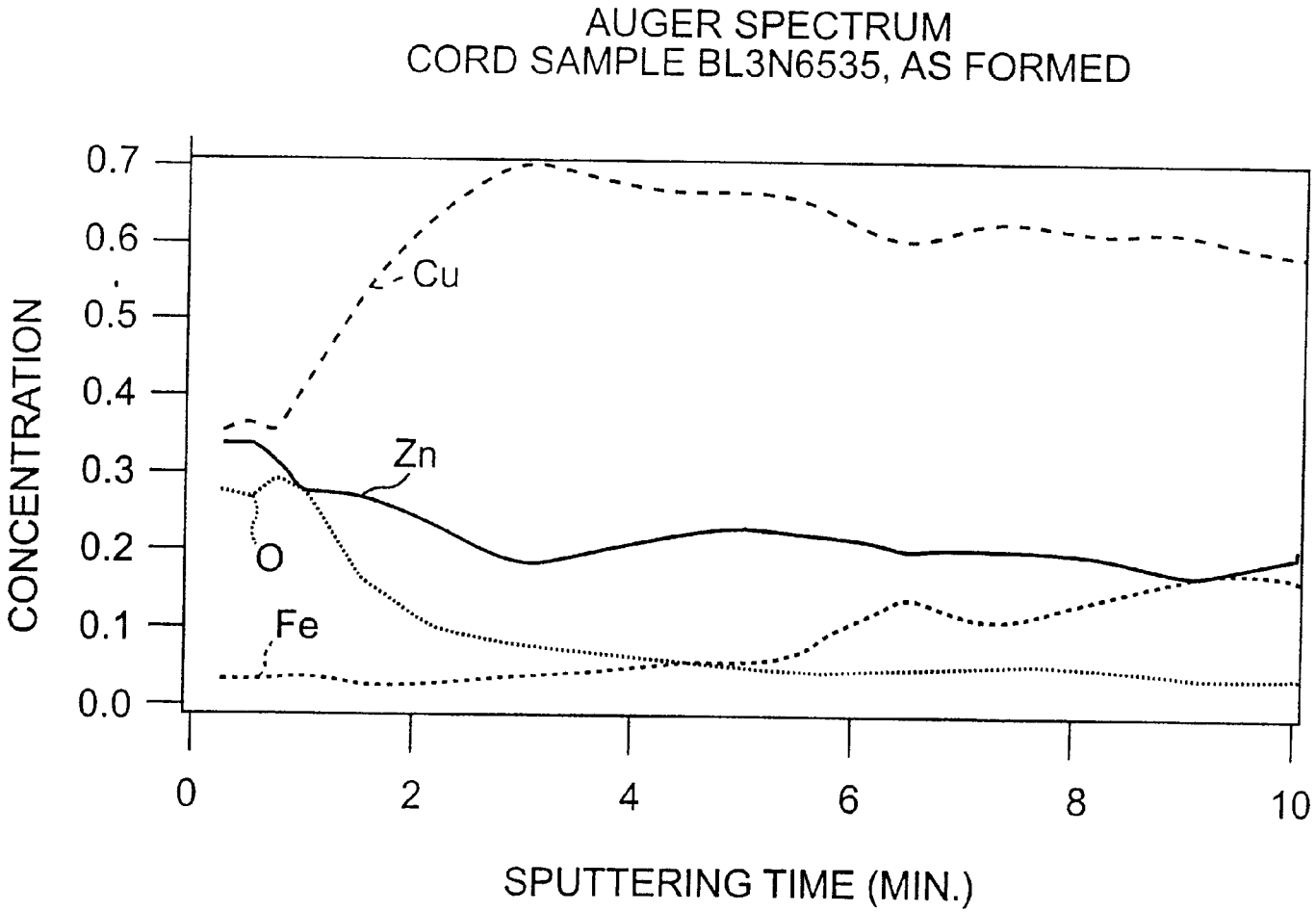
FIG. 1 is an Auger spectra diagram of a sample according to the invention showing the content of the constituents present in the brass coating and surface thereof bonded to the steel wire.

Reference will now be made in detail to the present preferred embodiments of the invention, examples of which are described in the accompanying specification and illustrated in the accompanying drawings.

Samples of brass coated wire (with deposition of three layers) in accordance with the invention were produced as identified in Table 1. In addition, sample BL2R80 was produced according to the invention, but utilizing only a first deposited layer of copper, and a second deposited layer of zinc.

TABLE 1

Samples of Wire Coated with Alternating Layers of Cu and Zn

| Sample | Thickness of Layer I (microns) Copper bath A | Thickness of Layer II (microns) Zinc | Thickness of Layer III (microns) Copper bath B |
|---|---|---|---|
| BL3N6535 | 0.65 | 0.6 | 0.35 |
| BL3R4040 | 0.4 | 0.5 | 0.4 |
| BL2R80 | 0.8 | 0.5 | — |
| BL3R6020 | 0.6 | 0.5 | 0.2 |
| BL3R7010 | 0.7 | 0.5 | 0.1 |
| BL3N8515 | 0.85 | 0.6 | 0.15 |
| BL3N2525 | 0.25 | 0.3 | 0.25 |
| BL3N3515 | 0.35 | 0.3 | 0.15 |

These samples were prepared in accordance with the following conditions:

First Copper Layer, Alkaline Galvanic Bath A:

Pyrophosphate of copper 80–120 g/l, preferably 100 g/l

Pyrophosphate of trihydrated potassium 350–450 g/l, preferably 400 g/l pH=8.6–8.9, preferably 8.7, adjusted with Pyrophosphoric acid Current density 5–16 A/dm$^2$ Temperature 50±5 Deg. C.

Second Zinc Layer, Acid Bath:

Sulfate of zinc heptahydrate 320–420 g/l, preferably 370 g/l

Sulfate of sodium 20–40 g/l, preferably 30 g/l pH=2–4, preferably 3

Current density 20–40 A/dm$^2$

Temperature 30±10 Deg. C.

Third Copper Layer, Alkaline Galvanic Bath B:

This bath is preferably designed to deposit copper on the previously deposited zinc layer.

Pyrophosphate of copper 60–80 g/l, preferably 70 g/l

Pyrophosphate of trihydrated potassium 250–350 g/l, preferably 300 g/l

Hydroxide of ammonium concentrate 1 g/l pH–8.6–8.9, preferably 8.7 g/l

Current density 5–16 A/dm$^2$

Temperature 50±5 Deg. C.

When more than three layers are deposited on the metal wire, the deposition steps described for the second and third layer are repeated. A copper layer is always deposited as the outermost layer, to provide a greater copper concentration near the outer surface of the brass coating for the metal wire. The outermost layer is preferentially copper, because it improves bonding of the wire with the elastomeric compound, as described above, and because an outer zinc layer tends to more rapidly wear the die of the drawing machine.

Preferential embodiments of the present invention include deposition of three or five layers as described above. Seven or more layers may also be deposited, however the electro-deposition steps become considerably more complicated as the number of layers increases.

The drawing operation reduces the diameter of the metal wire coated with copper and zinc layers. The diameter reduction can be, for example, from a starting diameter of approximately 0.8 to 3.0 mm to a final diameter of approximately 0.12 to 0.8 mm. The starting alloying layers in combination having a thickness of about 0.75 to 4.0 microns, and after the drawing operation the brass coating having a thickness of about 0.1 to 0.3 microns.

The thickness of the most external layer of copper is preferably about 0.1 to 0.5 microns. The thickness of the most external copper layer could be selected to obtain a desired copper concentration on an outer surface of the coated metal wire.

The plated wire is drawn to the final diameter by a drawing machine having a plurality of die passages, for example, 19 or 20, in order to obtain a reduction of the wire section between 10% and 12% through each die passage. The speed of the wire at the output of the die is between 16 and 20 m/s. The angle between the wire and the die is about between 8° and 12°. A water emulsion of lubricant (of the type well known to one skilled in the art) is used to reduce friction and cool the system. The pressure acting on the wire and coating in the die is approximately 1000 to 1500 MPa, as computed from the drawing force and the surface area of the die. The mean value of temperature to which the wire is subjected is approximately 150 Deg. C., calculated from the wire speed and other parameters. However, peak values of temperature in the die may be much higher and can reach hundreds of degrees Celsius.

The efficiency of the system is measured by counting the number of breakages occurring, and by measuring the amount of brass loss during drawing. Generally, a normal brass loss is about 5%–18% by weight from the starting amount.

Table 2 shows the results of drawing of the plated wire produced as described above.

TABLE 2

Drawing Ability of Samples (Speed 16 m/s; Emulsified Lubricant)

| Sample | Wire Produced (kg) | Number of Breakages | % Loss of Brass from Starting Amount |
|---|---|---|---|
| BL3N6535 | 60 | — | 10.7 |
| BL3R4040 | 40 | — | 13.5 |
| BL2R80 | 40 | 1 | 26 |

It should be noted that sample BL2R80, which only has two layers, the innermost layer being of copper and the outermost layer of zinc, has shown an inferior performance compared to the other samples.

The crystallographic phases of interest that are present in the alloy are the α phase, the β phase and the γ phase. The drawn brass coating, according to the present invention, is characterized by a face centered cubic alpha (α) phase structure with only trace amounts of the body centered cubic gamma (γ) and beta (β) phases, which are difficult to deform in contrast to the easy deformability of the face centered cubic alpha phase. The presence of only alpha phase in the brass alloy, with only traces of the beta and gamma phases, results in good drawing characteristics of the brass coated metal wire.

One technique used to evaluate the drawn brass coated wire is Auger spectroscopy. This technique gives the atomic concentration profile for the elements present in the coating. In the coating obtained according to one embodiment of the invention, the elements present were zinc, copper, iron, and oxygen. In particular, the average concentration of copper and zinc at the surface of the coating is related to the expected reactivity between the cords and the elastomeric compound material. The greater the copper concentration, the greater the reactivity. The concentration profile of the elements present in one of the samples of drawn coating is shown in the Auger spectrographic analysis presented in FIG. 1. In this figure, the y-axis represents the atomic concentration profile of specific elements with respect to the total concentration, and the x-axis represents the sputtering time (in minutes) corresponding to the time during which the wire was exposed to Argon ions bombardment. The sputtering time is proportional to the penetration of Argon ions in the alloy, and therefore indicates the depth from the surface of the wire where the analysis takes place. We can see in this figure that in a small portion near the surface of the wire, near t=0, there is a large number of oxides, due to the oxidation by contact with air. At a later time, corresponding to layers deeper within the wire, it is possible to see that the concentration of copper is high near the surface and is decreasing in a continuous way as we move deeper in the wire.

Once the wire is drawn, and the brass coating is formed, the drawn coated wire is used to form cords suitable for reinforcing the elastomeric compound material. The brass plated wires may be stranded to obtain various cord constructions, each optimized for a specific use. The cord may be composed by a different number of wires with various diameters. In the following examples, a 3×0.22 cord is used, formed from 3 wires of 0.22 mm diameter. The cords were then tested to evaluate their characteristics.

Figure 2:
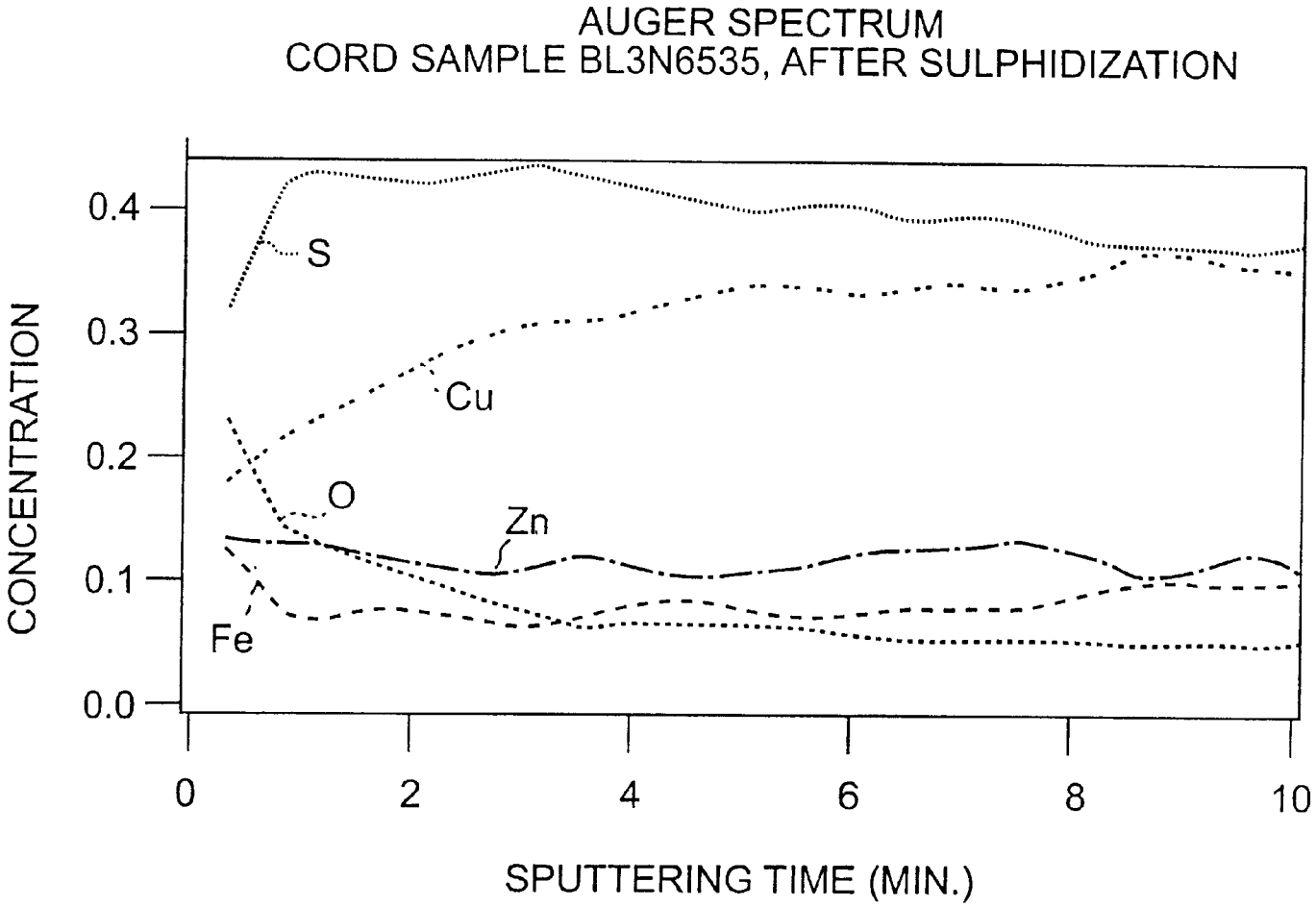
FIG. 2 is an Auger spectra diagram of a sample according to the invention showing the content of the constituents present in the brass coating and surface thereof bonded to the steel wire, following a sulphidization reaction.

The expected reactivity of the cord formed by the drawn coated wires can be measured by subjecting the cord to a sulphidization reaction. This reaction simulates the adhesion reaction between the metal surface and the elastomeric compound material. A sample of the cord is immersed in a solution of sulfur in xylene at the boiling point (138 Deg. C.) The sample is then analyzed using Auger spectroscopy to measure the sulfur content present. A high ratio of sulfur to copper indicates high reactivity, and a low ratio indicates low reactivity. FIG. 2 shows the Auger spectroscopy results for the same sample shown in FIG. 1, but after the sulphuring reaction.

The relative reactivity of different sample cords can be compared after sulphidization by measuring the sulfur to copper ratio for each sample, as described above. Table 3 shows this comparison for some of the samples described in Table 1. The relative reactivity is obtained by defining the reactivity of sample BL3N6535, which is the most reactive as being equal to 100. The other samples have a lower reactivity, ranging between 50 to 80% of the reactivity of sample BL3N6535.

TABLE 3

Reactivity of Cord Samples

| Sample | Reactivity (Relative Speed of sulphidization) |
|---|---|
| BL3N6535 | 100 |
| BL3R4040 | 70 |
| BL3R6020 | 60 |
| BL3R7010 | 50 |
| BL3N8515 | 80 |
| BL3N2525 | 80 |
| BL3N3515 | 70 |

In a preferred embodiment, the metal wire upon which the layers of copper and zinc are deposited is a steel wire. More preferably, the steel wire has one of the compositions described in Table 4.

TABLE 4

Composition of Steel Wire

| ELEMENT | STEEL 0.7% C | STEEL 0.8% C | STEEL 0.9% C |
|---|---|---|---|
| C | 0.735 | 0.810 | 0.896 |
| Si | 0.229 | 0.227 | 0.227 |
| Mn | 0.479 | 0.480 | 0.416 |
| P | 0.009 | 0.006 | 0.007 |
| S | 0.008 | 0.006 | 0.006 |
| Cr | 0.028 | 0.028 | 0.019 |
| Mo | 0.003 | 0.001 | 0.001 |
| Ni | 0.016 | 0.022 | 0.019 |
| Al | 0.001 | 0.001 | 0.001 |
| Cu | 0.009 | 0.009 | 0.009 |

In another embodiment according to the invention, an additional layer of material can be deposited on the metal wire before the copper and zinc layers are deposited, prior to drawing the metal wire. In particular, a layer of tin can be deposited as a first, or innermost layer on the metal wire prior to the deposition of the copper and zinc layers. Tin possesses excellent corrosion resistance properties, and can thus provide higher corrosion resistance to the drawn coated wire. The deposition of tin on the metal wire can be performed by electro-deposition; with a bath as follows:

Tin methanesulfonate 170 g/l

Methanesulfonic acid 100 g/l

Temperature 20–60 Deg. C., more preferably 45 Deg. C.

Cathodic current density 10–50 A/dm$^2$, more preferably 30 A/dm$^2$

Wire speed 18–50 m/min

The subsequent copper and zinc layers are deposited as described above, according to the invention. In this embodiment, brass is intended to include copper based alloys of copper, zinc, and small amounts of additional metals, such as tin. The alloy resulting from drawing the wire with the deposited layers described above, according to this embodiment, in a preferred embodiment has the following composition:

59–73% by weight of copper;

23–34% by weight of zinc;

2–13% by weight of tin.

Once the metal wire is coated with a brass layer according to the present invention, the wire can be used to reinforce various types of elastomeric articles, such as tires, hoses, or belts.

The metal wire is used as reinforcing metallic cord, in particular, in elastomer-matrix composite articles of manufacture, specifically in pneumatic tyres for motor-vehicles, according to the present invention. In a manner known per se, a tyre for vehicle wheels comprises a carcass of toric form having a crown region, two axially opposite sidewalls terminating at a radially internal position with corresponding beads for anchoring of the tyre to a corresponding mounting rim, said beads being each reinforced with at least one annular metal core, usually referred to as bead core, said carcass comprising at least one rubberized-fabric ply having its ends turned over around said bead cores, and optionally other reinforcing elements such as flippers, strips and bands of rubberized fabric. Said carcass further has a tread band disposed crownwise and moulded with a raised pattern designed to get in contact with a roadway while the tyre is running, and a belt structure, interposed between said tread band and said at least one carcass ply and comprising one or more rubberized-fabric strips reinforced with textile or metallic cords differently inclined in the corresponding strips, relative to the circumferential direction of the tyre.

The elastomeric articles can include known types of natural or synthetic rubber, including fillers and additives that are known in the art. For example, the elastomeric article can be made of a polymeric base natural and/or synthetic), carbon black, ZnO, stearic acid, antioxidants, anti-fatigue agents, plasticizers, sulphur, accelerating agents. A variety of methods to incorporate the coated metal wire in the elastomeric compound are known in the art, and can be used with the coated metal wire according to the invention.

It will be apparent to those skilled in the art that there are modifications and variations that can be made in the structure of the present invention, without departing from the spirit or scope of the invention. Thus, it is intended that the present invention covers the modifications and variations of this invention provided they come within the scope of the appended claims and their equivalents.

What is claimed is:

1. A metal wire having a copper-based alloy surface coating on said metal wire, formed according to the process of:

depositing on said metal wire at least three alternate unalloyed layers each being one of copper or zinc, with a most external of said unalloyed layers being copper; and drawing the metal wire with the unalloyed layers to obtain the copper-based alloy surface coating.

2. The metal wire of claim 1, wherein said metal wire has a diameter of about 0.85 to 3.0 mm, and said alternate unalloyed layers in combination have a thickness of about 0.75 to 4.0 microns.

3. The metal wire of claim 1, wherein said thickness of said most external layer of copper is about 0.1 to 0.5 microns.

4. The metal wire of claim 1, wherein the at least three alternate unalloyed layers are deposited by electro-deposition.

5. A metal wire having a copper-based alloy surface coating on said metal wire, formed according to the process of:

depositing a corrosion resisting layer of tin on the metal wire;

depositing on the layer of tin at least three alternate unalloyed layers each being one of copper or zinc, with a most external of said unalloyed layers being copper; and drawing the metal wire with the unalloyed layers to obtain the copper-based alloy surface coating.

6. The metal wire of claim 5, wherein the corrosion resisting and alternate unalloyed layers in combination consist essentially of, in weight percent, about 2 to 13 tin, about 23 to 34 zinc, and about 59 to 73 copper.

7. The metal wire of claim 5, wherein the corrosion resisting layer is deposited by electro-deposition.

8. A drawn metal wire, particularly adapted for use in wire reinforced elastomeric compound articles, comprising said metal wire having thereon a copper-based alloy coating, said copper-based alloy coating having an outer surface and an inner surface, wherein a copper content of an outer region of said copper-based alloy coating adjacent to said outer surface is greater than a copper content of an inner region of said copper-based alloy coating adjacent to said inner surface.

9. The drawn metal wire of claim 8, wherein said drawn metal wire is a steel wire.

10. The drawn metal wire of claim 8, wherein said copper-based alloy coating consists essentially of, in weight percent, about 60 to 72 copper and balance zinc.

11. The drawn metal wire of claim 8, wherein said drawn metal wire has a diameter of about 0.12 to 0.8 mm and said copper-based alloy coating has a thickness of about 0.1 to 0.3 micron.

12. The drawn metal wire of claim 8, wherein the inner region of the copper-based alloy coating contains tin.

13. The drawn metal wire of claim 12, wherein the copper-based alloy coating consists essentially of, in weight percent, about 2 to 13 tin, about 23 to 34 zinc, and about 59 to 73 copper.

* * * * *